United States Patent [19]

Liebman et al.

[11] 4,173,140

[45] Nov. 6, 1979

[54] TRIGGER DEVICE FOR EXPLOSION BARRIER

[75] Inventors: Israel Liebman, Library; Frank T. Duda, Oakdale; Ronald S. Conti, Pittsburgh, all of Pa.

[73] Assignee: The United States of America as represented by the Secretary of the Interior, Washington, D.C.

[21] Appl. No.: 874,953

[22] Filed: Feb. 3, 1978

[51] Int. Cl.[2] ..... G08B 17/00

[52] U.S. Cl. ..... 73/35; 340/522; 340/578; 340/626

[58] Field of Search ..... 73/35; 169/56, 64; 340/522, 523, 578, 626

[56] References Cited

U.S. PATENT DOCUMENTS

| | | | |
|---|---|---|---|
| 3,235,860 | 2/1966 | Vassil | 340/578 X |
| 3,831,318 | 8/1974 | Richmond | 340/522 X |

*Primary Examiner*—James J. Gill

*Attorney, Agent, or Firm*—Gersten Sadowsky; Donald A. Gardiner

[57] ABSTRACT

A trigger device for an explosion barrier includes a pressure sensor and at least two flame sensors. The pressure sensor energizes the flame sensors in response to a predetermined pressure rise, and the explosion barrier is triggered when a flame is detected by both flame sensors. The flame sensors are oriented at different angles in order to prevent false firing by miner's lamps, etc.

8 Claims, 3 Drawing Figures

FIG. 1
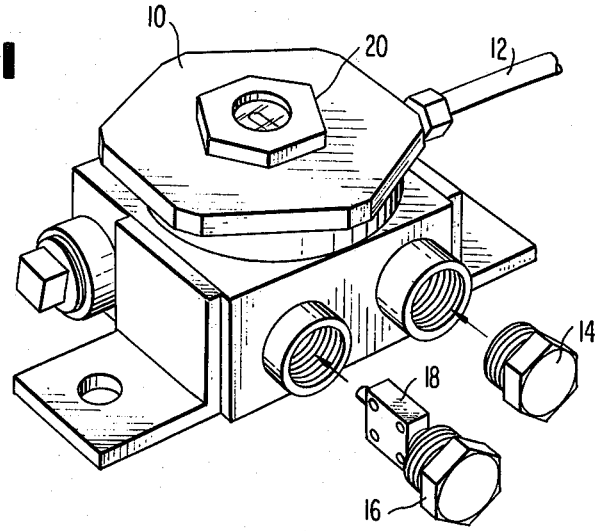
FIG. 2
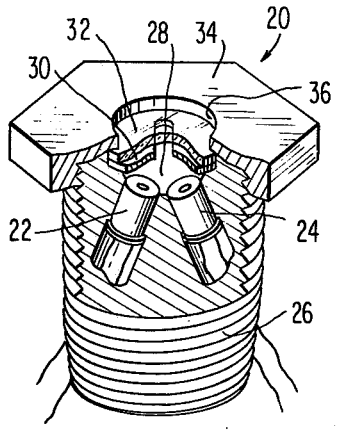
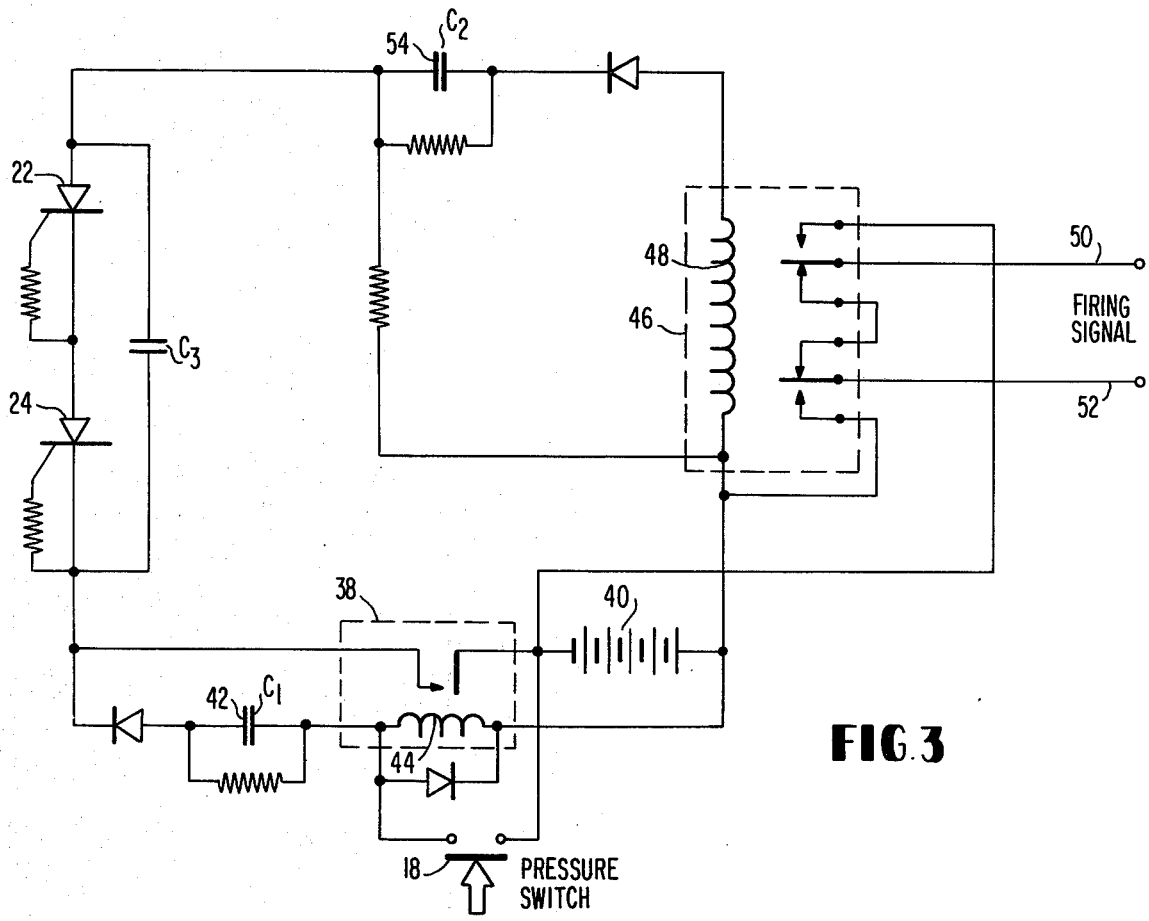
FIG. 3

TRIGGER DEVICE FOR EXPLOSION BARRIER

BACKGROUND OF THE INVENTION

This invention is related to systems for detecting fires or explosions in hazardous areas by detecting changes in the ambient conditions in the vicinity of the explosion.

When working in underground coal mines, sanitary sewers or other underground networks where flammable gases can accumulate, it is extremely important that one be able to quickly detect the occurrence of an explosion and erect some type of barrier to contain the explosion. An effective means of containing explosions in an underground coal mine is to provide a triggering device in the mine shaft upstream (on the explosion side) of a barrier so that when the triggering device senses conditions indicative of an explosion, the barrier may be triggered before the flame propagating from the explosion passes beyond it. The barrier may be of the type described in U.S. Pat. No. 3,958,644 in which a quantity of explosive suppression agent, usually water, is released from an overhead container. A variety of devices for triggering such explosion barriers have been developed.

Some triggering devices utilize thermocouples to sense directly the temperature rise of an explosion but such devices are limited to sensing the flame at a single point in space and may trigger late when the flame front does not fill the entire cross section of the mine shaft. Furthermore, they are slow in response and, therefore, trigger late unless extremely fine thermocouple wires are used in which case they are fragile and easily damaged by shocks and impacts. Finally, they may be falsely triggered by incidental flames or heat sources such as welding torches, etc.

A second type of device detects ultraviolet, visible, infrared or black body radiation emitted by the explosion flame, but these devices can be triggered by one or more false signals generated by miner's cap lamps, lights on vehicles or equipment for illumination, sparks or arcs and hot surfaces.

A third type of device may comprise a wind vane which responds to dynamic wind forces generated ahead of an explosion, but such devices are slow to respond, are sensitive to shocks and impacts, and can respond falsely to a roof fall or blasting concusion. Also, they may fire prematurely during a dust explosion since there is little or no correlation between dynamic wind force and flame location.

A fourth type of triggering device responds to the static pressure rise in the mine shaft, but such devices suffer from the same false and disadvantages as the dynamic wind-type devices discussed above.

Finally, a triggering system has been proposed in which a static pressure sensor is used to arm an infrared flame sensor which triggers the explosion barrier when the flame is detected. Such a system is described by D. B. Lull et al, "Development of a System to Suppress and Extinguish Fully Developed Coal Dust Explosions" Final Report, *NSWC/DL Technical Report TR-3151*, Feb. 1975. When a radiation source is within the view of the flame sensor, the proposed pressurearm trigger device may be falsely fired by a static pressure rise generated during either blasting or a roof fall or the device may be prematurely fired during a dust explosion. The above-cited report states, on page B-11 thereof, the possibility of utilizing multiple detectors for decreasing the probability of false firing, but does not elaborate further.

For maximum effectiveness, the explosion suppressant should be ejected in front of the approaching flame. If the trigger signal if premature, the suppressant wil! be driven downstream and its concentration diluted by the wind forces prior to be overtaken by the flame and, therefore, the efficiency of the suppressant will be decreased and explosion suppression will be delayed or not obtained at all. On the other hand, if the trigger signal is late, the suppressant will be delivered in back of the flame and the explosion will not be suppressed.

SUMMARY OF THE INVENTION

It is an object of this invention to provide a device for triggering an explosion barrier in response to changes in ambient conditions indicative of the occurrence of an explosion.

It is a further object of this invention to provide such a trigger device which is triggered very quickly when an explosion flame is detected.

It is a still further object of this invention to provide such a trigger device which is highly resistant to false or premature firing.

It is a still further object of this invention to provide such a triggering device which is sufficiently rugged to provide reliable operation in an underground mining environment.

These and other objects are achieved by providing a pressure-armed flame sensor wherein a pair of flame sensors are energized in response to a predetermined static pressure rise and the flame sensors trigger the explosion barrier when both of the sensors detect a flame simultaneously. The two flame sensors are aimed approximately 25° apart through a common vertical slot so that radiation sources of the type typically used in a mine will not be large enough to trigger both sensors simultaneously. The pressure sensor, flame sensors and associated electronic circuitry are all contained in a single small explosion proof box so that the device can be readily installed and removed as the location of the explosion barrier is shifted.

BRIEF DESCRIPTION OF THE DRAWINGS

The present invention will be more fully explained by the following description in conjunction with the accompanying drawing in which:

FIG. 1 is a perspective view of the triggering device according to the present invention;

FIG. 2 is a perspective, part-sectional view of the dual flame sensor portion of the triggering device shown in FIG. 1; and FIG. 3 is a schematic diagram of the triggering device shown in FIG. 1.

DETAILED DESCRIPTION OF THE PREFERRED EMBODIMENT

The complete sensor assembly according to the present invention is shown in FIG. 1. The sensor includes an explosion-proof housing 10 containing the pressure and flame sensors, and a cable 12 for transmitting the triggering signal to an explosion barrier. The pressure sensing arrangement includes a sintered plug 14 for equilibrating the inside of the housing with slow changes in the static pressure in the mine shaft, and an additional sintered plug 16 connected to one side of a pressure-responsive switch 18, the other side of the switch being exposed to the equilibrated pressure on the inside of the housing 10. The sintered plug 14 may, for example, be a Grade PC-30 Coarse plug having a mean pore opening of 0.0035 inches and sintered plug 16 may be a Grade PC-150 Super Fine plug having a mean pore opening of 0.0003 inches. Such plugs are manufactured by Powdercraft Corporation, Spartanburg, South Carolina. The pressure-responsive switch 18 may, for example, by an Ultra Low Pressure Sensor PSF 100A-12C manufactured by Fairchild Industrial Products, Commack, New York. A plug 20 contains two flame sensors.

FIG. 2 is an enlarged view of the plug 20 shown in FIG. 1, with part of the plug cut away to give a more detailed view of the internal arrangement of the sensors. The sensors, which may, for example, be L9U light activiated silicon controlled rectifiers manufactured by General Electric Company, Auburn, New York, are mounted within the threaded portion 26 of the plug at an angle of approximately 25° with respect to one another. This angle may, of course, vary depending upon the size of the tunnel to be monitored. A recess 28 is cut into the lower portion of the plug immediately above the sensors and into the recess are fitted a slotted metal disc 30 and a quartz window 32. An internally threaded upper portion 34 has a hole 36 which is slightly smaller in diameter than the quartz window 32 in order to fasten the window 32 and disc 30 in position when the unit is assembled.

The operation of the triggering device will now be described with reference to FIGS. 1 and 2 and also to FIG. 3 which is a schematic diagram of the electronic circuitry associated with the device. The triggering device is mounted approximately 50 feet upstream of the explosion barrier on a wall in the mine shaft with the sintered plugs 14 and 16 facing down and the dual light sensors sighting across the mine shaft. The sensors 22 and 24 are connected in series with a normally open relay 38 connected between the sensor 24 and battery 40. Thus, no power is drained from the battery under normal conditions. During a self-sustaining explosion, a static pressue rise exceeding 2 psi is always developed ahead of the propagating flame. The pressure-responsive switch 18 is set to operate at ½ psi in order to ensure that the switch will respond to the explosion-related pressure rise while still maintaining substantial immunity to incidental fluctuations in atmospheric pressure. Tests indicate that the above-proposed switch would close in less than 10 msec following a sharp rise in the pressure. When such a sharp pressure rise occurs, the switch 18 closes, thus providing energizing current to the relay 38. The relay 38 closes and supplies battery voltage to the sensors which now monitor the mine shaft for the occurrence of infrared radiation. Since the time between the sudden pressure rise and the arrival of the propagating flame at the trigger device is normally between 0.2 and 1.0 seconds, the relay 38 should remain energized for a short period of time. This time period is controlled by the capacitor 42 together with the inductance and resistance of the coil 44 of the relay, and should be at least 3 seconds. This will keep the device armed for sufficient time for the flame to reach the trigger device and will prevent disarming if the pressure fluctuates below ½ psi. Each of the infrared flame sensors 22 and 24 sights across the mine shaft at different angles through the slotted disc 22 and must detect radiation concurrently in order to energize the firing relay 46. When both flame sensors 22 and 24 are fired simultaneously, a circuit is completed through the coil 48 of the relay 46, thereby causing the firing signal leads 50 and 52 to be connected to the cathode and anode, respectively, of the battery 40. The firing signal remains on for only about 10 msec, the precise time period being determined by the capacitance 54 together with the inductance and resistance of the coil 48. This short firing duration fits within the requirements set forth in Title 30 of the Code of Federal Regulations for permissible explosion barrier detonation equipment in underground coal mines.

The triggering device according to the present invention was tested at the U.S. Bureau of Mines Experimental Mine at Bruceton, Pennsylvania, and found to operate satisfactorily during several dust explosions. In the tests conducted, the trigger device was used to fire a detonator to rupture a relief disc releasing a quantity of water to suppress the explosion.

Reduction of light sensor sensitivity due to contaminate coatings on the sensor window was also examined during explosion tests. When the window was coated with wet or dry layers of coal or rock dust, the wind forces preceding the flame cleansed the window sufficiently for the flame front to be readily detected. When a wetting agent was added to the water, the dust layer dried to a hard and strongly adhering coating lwhich was not easily removed by the wind forces. However, the flame front rapidly destroyed the coating but resulted in a time delay between flame arrival and detection of from 5 to 30 msec. Thin films of oil and grease on the windows had minimal effect on the ability of the device to detect the flame.

The use of a pressure-sensitivity switch to arm the flame sensors results in no power drain during normal operation and, consequently, the useful life of the battery 40 is approximately the shelf life. The use of the pressure-responsive switch to arm the flame sensors prevents premature firing since a pressure rise must first occur and then a flame must be detected within a predetermined time after the pressure rise. The chance of premature triggering by miner's cap lamps or other incidental light sources used in mining is extremely remote since two such sources would have to be aimed simultaneously at the device at specified angles and at a time immediately following activation of the pressure switch.

The triggering device described herein will respond rapidly and send a firing signal within 5 msec after arrival of the flame; it is small, completely contained in a rugged explosion-proof box and will withstand strong impacts without damage. The small pressure sensor used in the present invention is of considerable advantage in size and cost over previously used pressure sensors. Furthermore, the dual flame sensors used in the present invention are inexpensive and are not damaged by large radiation signals; and since they act as switches, no amplifiers or auxiliary equipment are needed for their operation.

The present invention can be used to trigger explosion barriers in coal mines, sanitary sewers or other underground networks for protection against flammable gas explosions, and may even be used to trigger such explosion barriers in aboveground industrial areas for protection against dust explosion along dust convenyors and loading areas, etc. where flammable dust clouds may form. It would be necessary, however, to change the flame sensors 22 and 24 to sensors which would detect radiation in the ultraviolet or higher infrared spectrum, depending on the composition of the particular gases or dust clouds which are likely to collect.

What is claimed is:

1. An apparatus for monitoring the conditions in an area where flammable materials can accumulate and providing a triggering signal when conditions indicative of an explosion are detected, comprising:

a pressure detector for detecting a sudden pressure increase in said area and providing an energizing signal in response thereto; and first and second radiation detectors for monitoring said area for radiation in response to said energizing signal, said first and second radiation detectors being mounted in a common housing with their axes angularly spaced, said radiation detectors detecting radiation through a common aperture in said housing whereby said first and second radiation detectors monitor nonoverlapping portions of said area, said apparatus providing said triggering signal when both of said radiation detectors simultaneously detect an amount of radiation indicative of the presence of an explosion-related flame.

2. A monitoring apparatus according to claim 1, wherein the axes of said detectors are oriented at an angle of approximately 25° with respect to one another.

3. A monitoring apparatus according to claim 1, wherein said common aperture is an elongated vertical slot so that said non-overlapping portions are narrow vertical sections of said area to be monitored.

4. An apparatus for monitoring the conditions in an area where flammable materials can accumulate and providing a triggering signal when conditions indicative of an explosion are detected, comprising:

a housing;

a pressure detector in said housing for detecting a sudden pressure increase in said area and providing an energizing signal in response thereto, said pressure detector comprising equilibration means, having a first side communicating with the interior of said housing and a second side communicating with said area, for equilibrating the pressure in the interior of said housing with slow fluctuations in the pressure in said area, and switch means for switching in response to a predetermined difference between the pressures on either side of said equilibration means; and first and second radiation detectors for monitoring said area for radiation in response to said energizing signal, said apparatus providing said triggering signal when both of said radiation detectors simultaneously detect an amount of radiation indicative of the presence of an explosion-related flame.

5. An apparatus for monitoring the conditions in an area where flammable materials can accumulate and providing a triggering signal when conditions indicative of an explosion are detected, comprising:

a pressure detector for detecting a sudden pressure increase in said area and providing an energizing signal in response thereto; and first and second radiation detectors for monitoring said area for radiation in response to said energizing signal, said radiation detectors being electrical devices connected in series with one another and also in series with a power source and a normally open first relay means, said first relay means being controlled by said pressure detector to close in response to said sudden pressure increase and to thereby provide said energizing signal to said radiation sensors, said apparatus providing said triggering signal when both of said radiation detectors simultaneously detect an amount of radiation indicative of the presence of an explosion-related flame.

6. A monitoring apparatus according to claim 5, wherein said first and second radiation detectors comprises radiation-responsive silicon controlled rectifiers.

7. A monitoring apparatus according to claim 5, wherein said radiation detectors are normally non-conductive and become conductive when said radiation is detected, said apparatus further comprising:

a second relay means having an energizing coil and providing said triggering signal when energized, said coil being connected in series with said radiation detectors, said first relay means and said power source, whereby said second relay means is energized only when said radiation is detected simultaneously by said first and second radiation detectors.

8. A monitoring apparatus according to claim 7, further comprising:

means for maintaining said first relay means in its closed position for a first determined period of time after energization by said pressure detector; and means for maintaining said second relay means in its energized state for a second predetermined perior of time after said radiation sensors become conducting.

* * * * *